US008212481B2

(12) United States Patent
Nakazato

(10) Patent No.: US 8,212,481 B2
(45) Date of Patent: Jul. 3, 2012

(54) VOLTAGE CONTROL APPARATUS, POWER SUPPLY APPARATUS, ELECTRON TUBE AND HIGH-FREQUENCY CIRCUIT SYSTEM

(75) Inventor: Yukihira Nakazato, Kanagawa (JP)

(73) Assignee: NEC Microwave Tube, Ltd, Kanagawa ( * ) Notice: Subject to any disclaimer, the term of this patent is extended or adjusted under 35 U.S.C. 154(b) by 431 days.

(21) Appl. No.: 12/395,994

(22) Filed: Mar. 2, 2009

(65) Prior Publication Data

US 2009/0218948 A1 Sep. 3, 2009

(30) Foreign Application Priority Data

Mar. 3, 2008 (JP) ..... 2008-051951

(51) Int. Cl.
*H01J 29/96* (2006.01)

(52) U.S. Cl. ..... 315/3; 315/3.5; 315/3.6; 315/39.3; 315/46; 330/43; 330/44; 330/45; 330/127; 330/129

(58) Field of Classification Search ..... 315/3, 3.5, 315/3.6, 39.3, 46; 330/43, 44, 45, 127, 129
See application file for complete search history.

(56) References Cited

U.S. PATENT DOCUMENTS

| | | | | |
|---|---|---|---|---|
| 4,323,853 | A * | 4/1982 | Kurokawa | 330/43 |
| 5,500,621 | A * | 3/1996 | Katz et al. | 330/43 |
| 6,236,122 | B1 * | 5/2001 | Maeda et al. | 307/125 |
| 6,777,876 | B2 * | 8/2004 | Kobayashi et al. | 315/3.5 |
| 7,034,462 | B2 * | 4/2006 | Abiko et al. | 315/3.5 |
| 7,071,624 | B2 * | 7/2006 | Tsuchida | 315/3.5 |
| 7,489,084 | B2 * | 2/2009 | Kobayashi et al. | 315/3.5 |
| 2005/0057159 | A1 * | 3/2005 | Abiko et al. | 315/39.3 |

FOREIGN PATENT DOCUMENTS

| | | | |
|---|---|---|---|
| JP | 1982186966 | A | 11/1982 |
| JP | 1986157251 | A | 9/1986 |
| JP | 1992076240 | A | 7/1992 |
| JP | 2005093229 | A | 4/2005 |

* cited by examiner

*Primary Examiner* — Douglas W Owens
*Assistant Examiner* — Thai Pham

(57) ABSTRACT

A voltage control apparatus used for an electron tube or a power supply apparatus includes a detecting circuit for detecting current flowing through a helix electrode, a voltage-limiting circuit for controlling a potential difference between the helix electrode and the anode electrode based on a predetermined voltage level; and a switch for switching based on an output from the detecting circuit. The switch connects the helix electrode and the anode electrode through the voltage-limiting circuit, or causes a short circuit between the helix electrode and the anode electrode.

7 Claims, 12 Drawing Sheets

VOLTAGE CONTROL APPARATUS, POWER SUPPLY APPARATUS, ELECTRON TUBE AND HIGH-FREQUENCY CIRCUIT SYSTEM

This application is based upon and claims the benefit of priority from Japanese patent application No. 2008-051951, filed on Mar. 3, 2008, the disclosure of which is incorporated herein in its entirety by reference.

TECHNICAL FIELD

The present invention relates to a voltage control apparatus for controlling a direct voltage supplied to respective electrodes of an electron tube, a power supply apparatus and an electron tube having the voltage control apparatus, and a high-frequency circuit system having the same.

BACKGROUND ART

A Traveling Wave Tube (TWT) or a klystron is an electron tube used for amplifying or oscillating a high-frequency signal through interaction between a beam of electrons emitted from an electron gun or the like and a high-frequency circuit.

Referring to FIG. 1, a TWT 1 includes electron gun 10 for emitting a beam of electrons 50, helix electrode 20 functioning as a high-frequency circuit that allows a beam of electrons 50 emitted from electron gun 10 to interact with a high-frequency signal (i.e. a microwave signal), collector electrode 30 for collecting beam of electrons 50 emitted from helix electrode 20, and anode electrode 40 for drawing out electrons from electron gun 10 as well as guiding the beam of electrons 50 emitted from electron gun 10 into helix electrode 20. Electron gun 10 has cathode electrode 11 for emitting thermal electrons and heater 12 for supplying thermal energy for causing emission of the thermal electrons.

The beam of electrons 50 emitted from electron gun 10 is accelerated by the electric potential difference between cathode electrode 11 and helix electrode 20 before entering helix electrode 20, and then travels inside helix electrode 20 while interacting with the high-frequency signal inputted through one end of helix electrode 20. After the beam of electrons 50 has passed through helix electrode 20, collector electrode 30 captures the beam of electrons 50. Here, the high-frequency signal, amplified through interaction with the beam of electrons 50, is outputted through the other end of helix electrode 20.

Power supply apparatus 60 supplies a helix voltage $E_{hel}$, which is a negative direct voltage based on the potential HELIX of helix electrode 20, to cathode electrode 11. In addition, power supply apparatus 60 supplies a collector voltage $E_{col}$, which is a positive direct voltage based on the potential H/K of cathode electrode 11, to collector electrode 30, and supplies a heater voltage $E_h$, which is a negative direct current based on the potential H/K of cathode electrode 11, to heater 12. In general, helix electrode 20 is connected to a case of TWT 1 and is thereby grounded.

While FIG. 1 illustrates an example construction of TWT 1 having one collector electrode 30, TWT 1 may have a plurality of collector electrodes 30. Although FIG. 1 illustrates a construction in which anode electrode 40 and helix electrode 20 are connected inside power supply apparatus 60, it can be constructed such that anode electrode 40 is supplied with an anode voltage $E_a$, which is a positive voltage with respect to the potential H/K of cathode electrode 11.

Helix voltage $E_{hel}$, collector voltage $E_{col}$, and heater voltage $E_h$ are generated using, for example, a transformer, an inverter and a rectification circuit. The inverter serves to convert a direct voltage supplied from the outside into an alternating voltage and is connected to a first coil of the transformer. The rectification circuit serves to convert an alternating voltage outputted from a second coil of the transformer into a direct voltage.

Since TWT 1 draws out electrons from cathode electrode 11 using the potential difference between anode electrode 40 and cathode electrode 11, it is preferable that the potential difference between anode electrode 40 and cathode electrode 11 be as small as possible in a state where an instable voltage is supplied to respective electrodes at the time when helix voltage $E_{hel}$ or collector voltage $E_{col}$ is raised (inputted).

When there is a potential difference between anode electrode 40 and cathode electrode 11 at the time when helix voltage $E_{hel}$ or collector voltage $E_{col}$ is inputted, a portion of electrons drawn out from cathode electrode 11 flows through helix electrode 20 to a ground potential. This causes an excessive amount of current to flow through helix electrode 20, thereby causing deterioration or damage to TWT 1. In particular, in the construction in which anode electrode 11 and helix electrode 20 shown in FIG. 1 are connected to each other, a potential difference occurs at the same time when helix voltage $E_{hel}$ is inputted. It is preferable to reduce the potential difference using any means.

As an attempt to avoid such a problem, Japanese Laid-Open Patent Application No. 2005-093229 (hereinafter, referred to as patent document 1) discloses a construction for controlling the supply and cutting-off of an anode voltage using a circuit, which is implemented with a Field Effect Transistor (FET).

FIG. 2 is a block diagram illustrating the construction of a high-frequency circuit system disclosed in patent document 1.

As shown in FIG. 2, the high-frequency circuit system disclosed in patent document 1 includes transistor Q1 and a transistor Q2 provided for on/off control of transistor Q1. In transistor Q1, a source is connected to a cathode electrode of TWT 1 and a drain is connected to a helix electrode via anode electrode A of TWT 1 and via resistor R1. Here, transistor Q1 is an N-channel FET, and transistor Q2 is an N-channel Metal-Oxide Semiconductor FET (MOSFET).

Transistor Q1 has a gate connected to a drain of transistor Q2, and resistor R2 is connected in parallel between the gate and the source of transistor Q1. Transistor Q2 has a source connected to a heater of TWT 1. A gate of transistor Q2 is applied with a voltage, which is obtained by dividing a voltage between the helix electrode and the heater of TWT 1 using resistors R3 and R4.

According to this construction, in a time period when helix voltage $E_{hel}$ and collector voltage $E_{col}$ are being raised (i.e., inputted), transistor Q1 is switched on so that the potential of anode electrode A is substantially identical with the potential of cathode electrode H/K. When helix voltage $E_{hel}$ and collector voltage $E_{col}$ are raised to a predetermined level, transistor Q1 is switched off so that the potential of anode electrode A is substantially identical with ground potential HELIX. Timing to switch transistor Q1 from "on" to "off" is determined by the voltage division ratio between resistors R3 and R4 connected to the gate of transistor Q2.

In the high-frequency circuit system shown in FIG. 2, as shown in FIG. 3, only a faint amount of current $I_{HELIX}$ flows to the helix electrode of TWT 1 when transistor Q1 is switched from on to off. As a result, this can prevent an excessive amount of current from flowing to the helix electrode, as otherwise an excessive amount of current would deteriorate or damage TWT 1. In the meantime it should be understood that the characteristics of the anode voltage and the helix voltage schematically represent changes in the voltages based on the potential H/K of the cathode electrode but are not actual voltage values.

Other attempts to reduce the potential difference between the anode electrode and the cathode electrode when helix voltage $E_{hel}$ and collector voltage $E_{col}$ are inputted are disclosed, for example, in Japanese Laid-Open Utility Model Application No. S57-186966 (hereinafter, referred to as patent document 2), Japanese Laid-Open Utility Model Application No. S61-157251 (hereinafter, referred to as patent document 3) and Japanese Laid-Open Utility Model Application No. H04-076240 (hereinafter, referred to as patent document 4).

As shown in FIG. 4, patent documents 2 through 4 disclose a construction in which resistors R11 and R12 are connected in series between the helix electrode and the cathode electrode of TWT 1 and resistors R11 and R12 supply a voltage obtained by dividing helix voltage $E_{hel}$.

In the construction as shown in FIG. 4, when compared with the construction shown in FIG. 1 in which the anode electrode and the helix electrode of TWT 1 are connected to each other, a current flowing through the helix electrode can be reduced when helix voltage $E_{hel}$ and collector voltage $E_{col}$ are inputted. This is because the potential difference between the anode electrode and the cathode electrode is reduced.

As described above, in the construction shown in FIG. 1 in which the anode electrode and the helix electrode of TWT 1 are connected to each other, when helix voltage $E_{hel}$ and collector voltage $E_{col}$ are inputted, an excessive amount of current may flow through the helix electrode thereby causing deterioration or damage to the TWT. The construction shown in FIG. 2 or FIG. 4 is proposed to avoid such a problem.

However, in the construction shown in FIG. 2, since a current flows through the anode electrode when transistor Q1 is open, that is, TWT 1 performs a normal operation, the current also flows through resistor R1 connected between the helix electrode and the drain. Then, as a drawback, the potential of the anode electrode decreases (to a value close to the potential H/K of the cathode electrode), thereby decreasing the maximum gain of TWT 1.

For example, if a current flowing through the anode electrode in the normal operation of TWT 1 is 0.1 mA and if the resistance of resistor R1 is 10 MΩ, the potential of the anode electrode decreases by 1 kV compared to the potential of the helix electrode. If the resistance of resistor R1 is reduced, the potential difference between the anode electrode and the helix electrode can be reduced in the normal operation. However, resistor R1 requires a large amount of rated power since it consumes a large amount of power due to helix voltage $E_{hel}$ that is applied when transistor Q1 is on.

Furthermore, in the construction shown in FIG. 4, a voltage obtained by dividing helix voltage $E_{hel}$ using resistors R11 and R12 is applied to anode electrode A when TWT 1 performs a normal operation. Accordingly, as a drawback, the anode voltage is reduced in the normal operation of TWT 1, thereby decreasing the maximum gain of TWT 1.

SUMMARY

The object of the present invention to provide a voltage control apparatus, which can prevent an excessive amount of current from flowing through a helix electrode when a helix voltage and a collector voltage are raised so as to prevent an electron tube such as a Traveling Wave Tube (TWT) from deterioration or damage as well as to reduce the load on a power supply apparatus without reducing the maximum gain in normal operation of the electron tube, and also to provide a power supply apparatus and an electron tube having the voltage control apparatus, and a high-frequency circuit system having the same.

According to an aspect of the present invention, there is provided a voltage control apparatus used for an electron tube, which includes at least an anode electrode, a cathode electrode and a helix electrode. The voltage control apparatus may include a detecting circuit for detecting a current flowing through the helix electrode; a voltage-limiting circuit for controlling a potential difference between the electrode and the anode electrode based on a predetermined voltage level; and a switch for connecting the helix electrode and the anode electrode through the voltage-limiting circuit or for causing a short circuit between the helix electrode and the anode electrode based on the output from the detecting circuit.

According to another aspect of the present invention, there is provided a power supply apparatus including the above-described voltage control apparatus According to a further aspect of the present invention, there is provided an electron tube including the above-described voltage control apparatus.

According to yet another aspect of the present invention, there is provided a high-frequency circuit system. The high-frequency circuit system may include: the above-described power supply apparatus; and an electron tube in which a direct voltage from the power supply apparatus is supplied to an anode electrode, a cathode electrode and a helix electrode.

According to yet another aspect of the present invention, there is provided a high-frequency circuit system. The high-frequency circuit system may include: the above-described electron tube; and a power supply apparatus for supplying a direct voltage to an anode electrode, a cathode electrode and a helix electrode of the electron tube.

The above and other objects, features, and advantages of the present invention will become apparent from the following description with reference to the accompanying drawings, which illustrate examples of the present invention.

EXEMPLARY EMBODIMENT

The present invention will be described more fully hereinafter with reference to the accompanying drawings, in which preferred embodiments thereof are shown.

Although a Traveling Wave Tube (TWT) will be illustrated as an example of an electron tube of a high-frequency circuit system, the present invention can also be applied to any construction in which a direct voltage is applied to respective electrodes in different types of electron tube.

(First Exemplary Embodiment)

Figure 5:
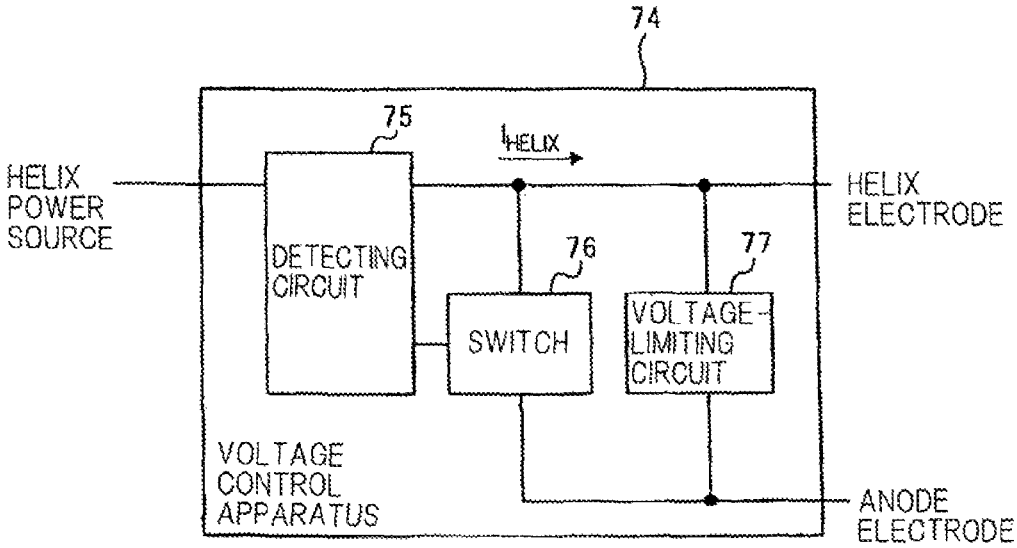
FIG. 5 is a circuit diagram illustrating the construction of a voltage control apparatus according to a first exemplary embodiment.

FIG. 5 is a circuit diagram illustrating the construction of a voltage control apparatus according to a first exemplary embodiment of the invention.

Voltage control apparatus 74 illustrated in FIG. 5 is constructed to reduce helix current $I_{HELIX}$, i.e., a current flowing through the helix electrode of TWT 1 (see FIG. 7) by restraining an anode voltage in response to the detection of an increase in helix current $I_{HELIX}$ when helix voltage $E_{hel}$ and collector voltage $E_{col}$ are inputted to TWT 1.

As shown in FIG. 5, voltage control apparatus 74 includes detecting circuit 75, switch 76 and voltage-limiting circuit 77.

Detecting circuit 75 is connected between a helix power source generating helix voltage $E_{hel}$ and the helix electrode of TWT 1 (see FIG. 7) to detect helix current $I_{HELIX}$ flowing through the helix electrode of TWT 1, as well as to perform on/off control on switch 76. Detecting circuit 75 turns on switch 76 when helix current $I_{HELIX}$ does not exceed a predetermined threshold, but turns off switch 76 when helix current $I_{HELIX}$ exceeds the threshold.

Switch 76 is connected between the helix electrode and an anode electrode of TWT 1 (see FIG. 7) and is turned on/off according to an output signal from detecting circuit 75 to connect the helix electrode and the anode electrode through voltage-limiting circuit 77 or to cause a short circuit between the helix electrode and the anode electrode.

Voltage-limiting circuit 77 is connected between the helix electrode and the anode electrode of TWT 1 (see FIG. 7), and when switch 76 is turned off, controls the potential difference between the helix electrode and the anode electrode based on a predetermined value.

Figure 6:
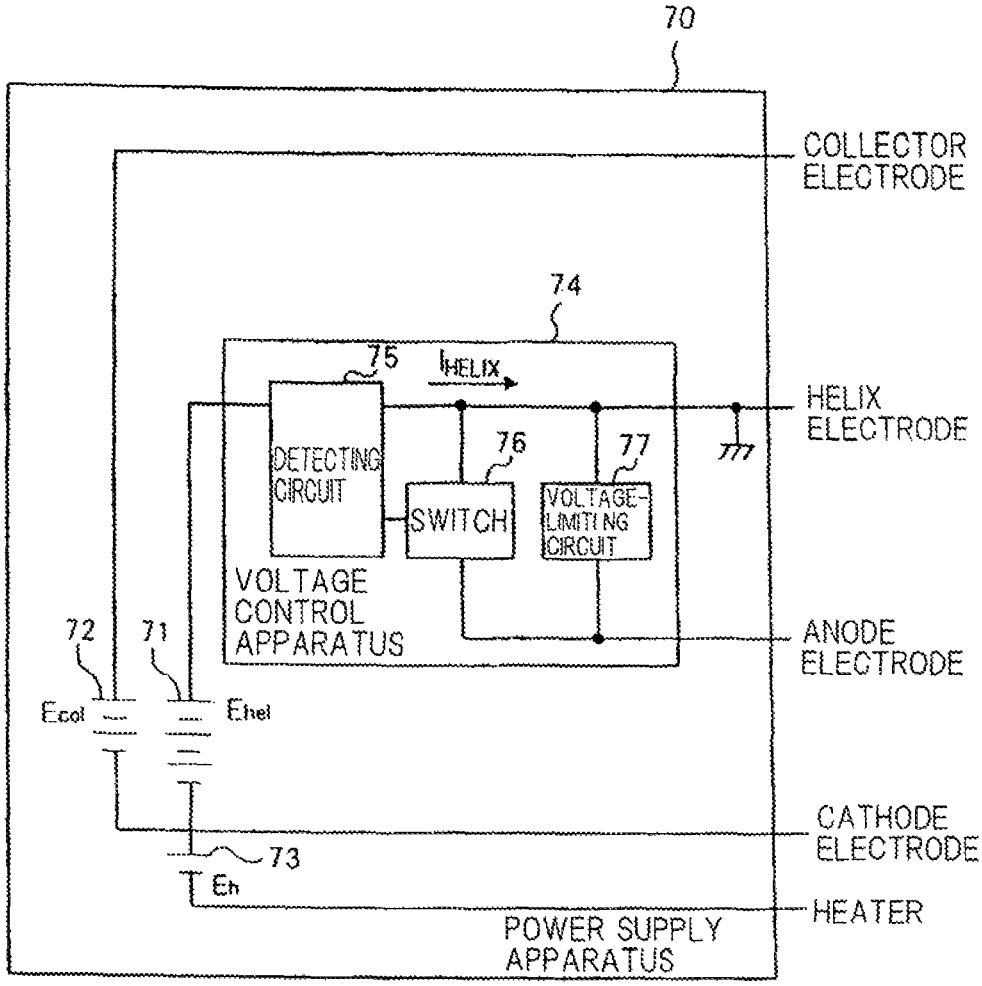
FIG. 6 is a block diagram illustrating the construction of a power supply apparatus including the voltage control apparatus shown in FIG. 5.

FIG. 6 is a block diagram illustrating the construction of a power supply apparatus including the voltage control apparatus shown in FIG. 5.

Referring to FIG. 6, power supply apparatus 70 according to the first exemplary embodiment includes helix power source 71 for generating helix voltage $E_{hel}$ supplied to TWT 1 (see FIG. 7) collector power source 72 for generating collector voltage $E_{col}$, heater power source 73 for generating heater voltage $E_h$ and power control apparatus 74 shown in FIG. 5.

Figure 7:
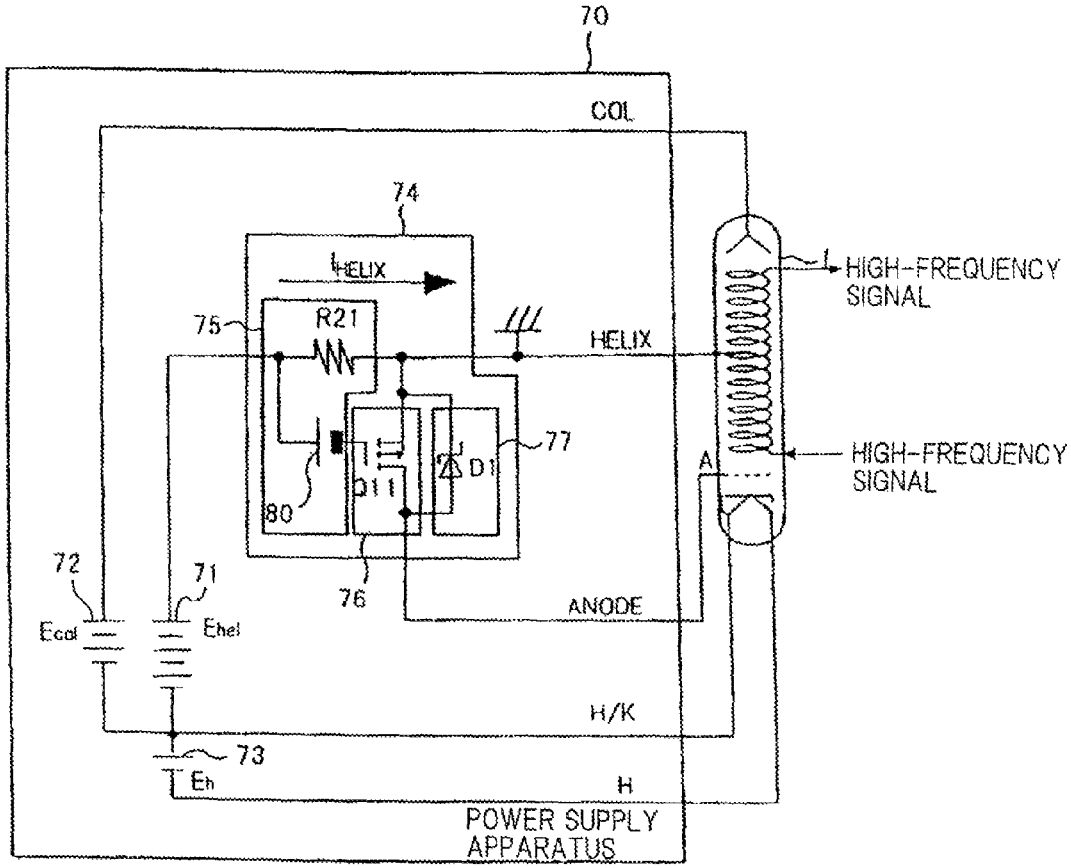
FIG. 7 is a block diagram illustrating the construction of a high-frequency circuit system according to the first exemplary embodiment.

As shown in FIG. 6, in power control apparatus 74, detecting circuit 75 has one end connected to helix power source 71 and the other end connected to the helix electrode of TWT 1 (see FIG. 7). The other end of detecting circuit 75 is grounded inside Dower supply apparatus 70.

Switch 76 and voltage-limiting circuit 77 of power control apparatus 74 are connected between the helix electrode and the anode electrode of TWT 1 (see FIG. 7).

Below, with reference to FIG. 7, a description will be made of a high-frequency circuit system according to this exemplary embodiment using the exemplary construction of voltage control apparatus 74 shown in FIGS. 5 and 6.

FIG. 7 is a block diagram illustrating the construction of a high-frequency circuit system according to the first exemplary embodiment.

As shown in FIG. 7, the high-frequency circuit system according to the first exemplary embodiment includes TWT 1 and power supply apparatus 70 (shown in FIG. 6) for supplying a direct voltage (i.e., a supply voltage) to respective electrodes of TWT 1. Since TWT 1 shown in FIG. 7 has substantially the same construction as TWT 1 of the related art shown in FIG. 1, a description thereof will be omitted.

Power supply apparatus 70 supplies helix voltage $E_{hel}$ from helix power source 71 to a cathode electrode of TWT 1 through voltage control apparatus 74. In addition, power supply apparatus 70 supplies collector voltage $E_{col}$ from collector power source 72 to the collector electrode of TWT 1, where collector voltage $E_{col}$ is a positive voltage with respect to the potential H/K of the cathode electrode, and supplies a heater electrode $E_h$ from heater power source 73 to a heater of TWT 1, where the heater electrode $E_h$ is a negative voltage with respect to the potential H/K of the cathode electrode.

When a predetermined amount of voltage is supplied from power supply apparatus 70 to the cathode electrode, the collector electrode and the heater of TWT 1 shown in FIG. 7, it emits a beam of electrons from the cathode electrode to the collector electrode and outputs a high-frequency signal inputted to the helix electrode by amplifying the high-frequency signal through the interaction between the high-frequency signal and the beam of electrons.

As shown in FIG. 7, voltage control circuit 77 of this exemplar embodiment uses Zener diode D1 that limits the potential difference between the helix electrode and anode electrode A within the Zener voltage. Zener diode D1 has a cathode connected to the helix electrode of TWT 1 and an anode connected to anode electrode A of TWT 1.

Switch 76 of voltage control apparatus 74 is implemented with transistor Q11 made of a P-channel Metal-Oxide Semiconductor Field Emission Transistor (MOSFET). Transistor Q11 has a source connected to the helix electrode of TWT 1 and a drain connected to anode electrode A of TWT 1.

Detecting circuit 75 includes direct voltage source 80 for supplying a negative direct voltage to the gate of transistor Q11 and current-detecting resistor R21 connected between the source of transistor Q11 and direct voltage source 80.

Direct voltage source 80 has a positive electrode connected to helix power source 71 and a negative electrode connected to the gate of transistor Q11. When TWT 1 performs a normal operations direct voltage source 80 outputs a constant direct voltage) which turns on transistor Q11. The level of the voltage from direct voltage source 80 is a threshold for determining the turning on or off of transistor Q11 (of the switch 76). Direct voltage source 80 can be implemented with a power circuit well-known in the art, and can be implemented with any circuits as long as they can generate and output a constant direct voltage.

Current-detecting resistor R21 has one end connected to the source of transistor Q11 and the other end connected to helix power source 71, and generates a potential difference according to helix current $I_{HELIX}$. When an excessive amount of helix current $I_{HELIX}$ flows through current-detecting resistor R21, the potential difference causes a voltage, applied from direct voltage source 80 to the gate of transistor Q11, to drop below the operating voltage of transistor Q11 (i e., to drop to a voltage level at which transistor Q11 is turned off). That is, detecting circuit 75 turns on transistor Q11 (switch 76) when helix current $I_{HELIX}$ does not exceed a predetermined threshold but turns off transistor Q11 (switch 76) when helix current $I_{HELIX}$ exceeds the threshold.

Below, a description will be made of the operation of the high-frequency circuit according to this exemplary embodiment with reference to the drawing.

Figure 8:
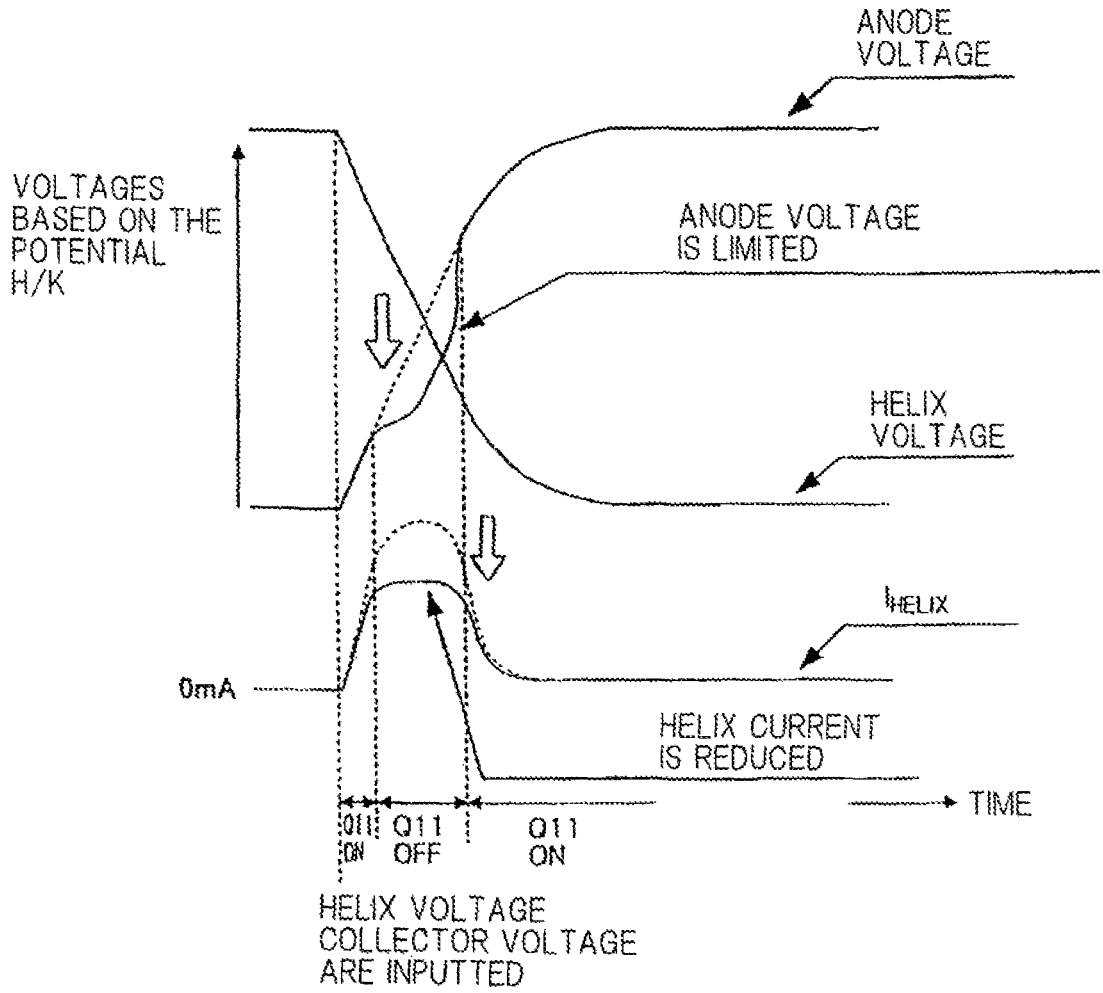
FIG. 8 is a schematic diagram illustrating changes in helix voltage, anode voltage and helix current, which are raised by a power supply apparatus according to the first exemplary embodiment.

FIG. 8 is a schematic diagram illustrating changes in helix voltage, anode voltage and helix current, which are raised by a power supply apparatus according to the first exemplary embodiment. In the meantime, it should be understood that the characteristics of the anode voltage and the helix voltage schematically represent changes in the voltages based on the potential H/K of the cathode electrode but are not actual voltage values. In the meantime, it shall be assumed that direct voltage source 80 outputs a predetermined constant level of direct voltage before helix voltage $E_{hel}$ and collector voltage $E_{col}$ are inputted.

When TWT 1 performs a normal operation, a potential difference does not occur between both ends of current-detecting resistor R21 since substantially no helix current $I_{HELIX}$ flows through the helix electrode of TWT 1. Thus, the positive electrode of direct voltage source 80 and the source of transistor Q11 have substantially the same potential.

In this case, since a predetermined level of direct voltage is applied from direct voltage source 80 to the gate of transistor Q11, transistor Q11 is turned on and short circuit occurs between the anode electrode and helix electrode of TWT 1. Accordingly, the anode electrode of TWT 1 has substantially the same potential as that of the helix electrode (i.e., a ground potential GND) and thereby prevents the maximum gain of TWT 1 from decreasing in normal operation.

When helix voltage $E_{hel}$ and collector voltage $E_{col}$ are applied and helix current $I_{HELIX}$ flows from helix power source 71 to the helix electrode of TWT 1, a potential difference occurs between both ends of current-detecting resistor R21.

Since direct voltage source 80 applies a constant negative level of direct voltage with respect to the potential of the positive electrode of helix power source 71 to the gate of transistor Q11 a potential difference occurs between the both ends of current-detecting resistor R21 which raises the potential of the positive electrode of direct voltage source 80 while lowering the potential difference between the source and the gate of transistor Q11.

As a result, helix current $I_{HELIX}$ is enhanced to increase the potential difference between the both ends of current-detecting resistor R21. When the potential difference between the source and the gate of transistor Q11 does not exceed the threshold voltage, transistor Q11 is turned off.

In this case, a voltage applied to anode electrode A of TWT 1 is limited to a voltage level, which is lowered from the potential of the helix electrode by the Zener voltage of Zener diode D1 (in the direction of the potential H/K of the cathode electrode). Therefore, as shown in FIG. 8, helix current $I_{HELIX}$ is reduced since the anode voltage is limited in the case where helix voltage $E_{hel}$ and collector voltage $E_{col}$ are inputted.

When helix voltage $E_{hel}$ and collector voltage $E_{col}$ reach a predetermined voltage level and the reduced helix current $I_{HELIX}$ decreases the potential difference between the both ends of current-detecting resistor R21, transistor Q11 is turned on to cause a short circuit between the anode electrode and the helix electrode of TWT 1.

Figure 1:
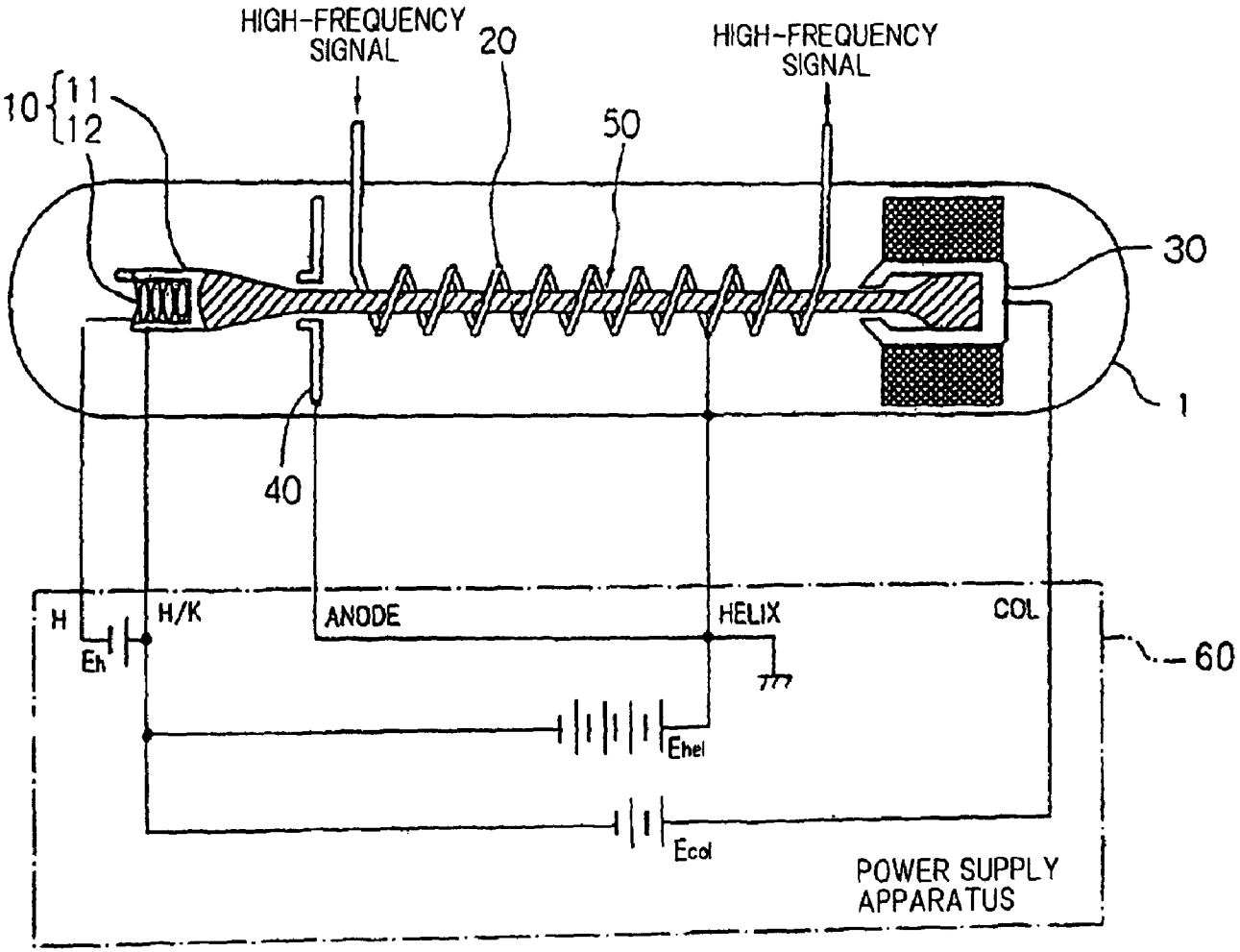
Fig. 1 (PRIOR ART)
FIG. 1 is a block diagram illustrating a high-frequency circuit system of the related art.
Figure 2:
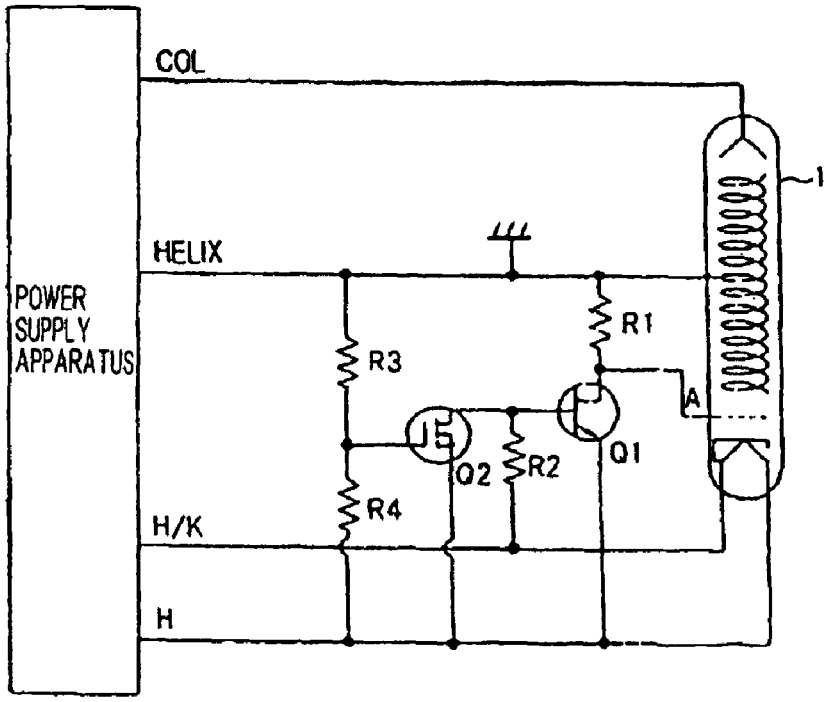
Fig.2 (PRIOR ART)
FIG. 2 is a block diagram illustrating the construction of a high-frequency circuit system disclosed in patent document 1.
Figure 3:
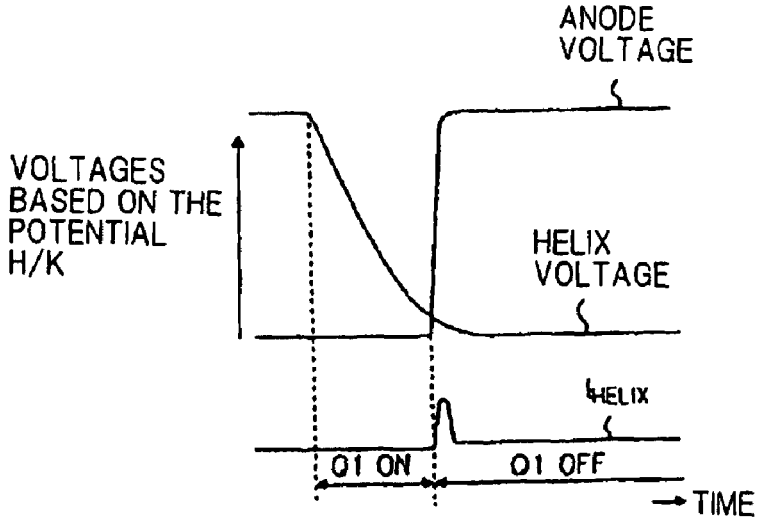
Fig.3 (PRIOR ART)
FIG. 3 is a schematic diagram illustrating changes in a helix voltage, an anode voltage and a helix current, which are raised in the high-frequency circuit system shown in FIG. 2.
Figure 4:
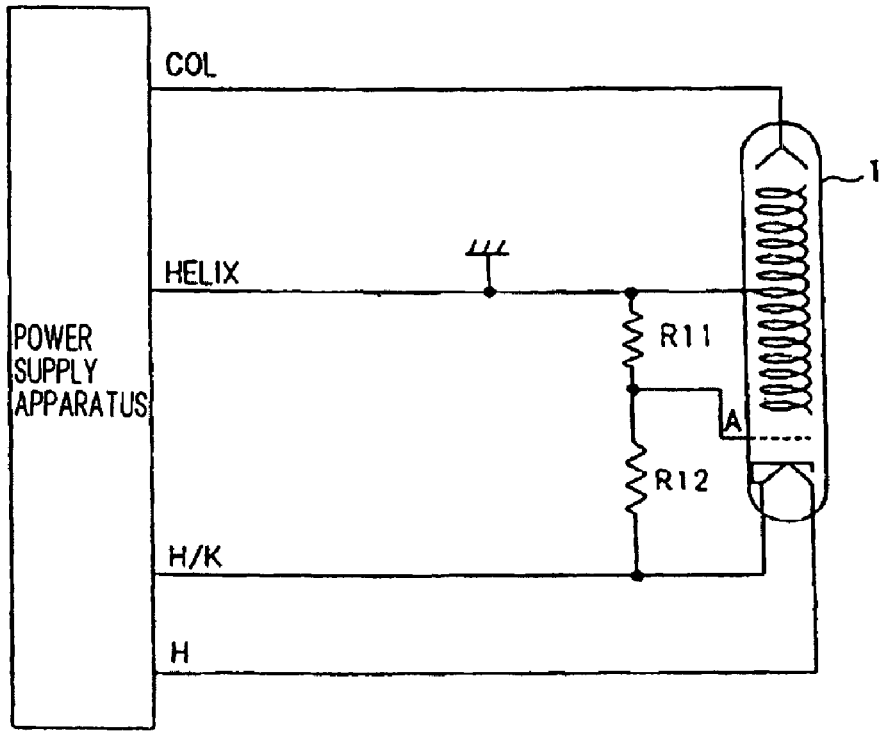
Fig.4 (PRIOR ART)
FIG. 4 is a block diagram illustrating the construction of a high-frequency circuit system, in which a voltage divided by resistors is supplied to an anode electrode.

According to the high-frequency circuit system of this exemplary embodiment, at the beginning of inputting helix voltage $E_{hel}$ and collector voltage $E_{col}$ helix current $I_{HELIX}$ that flows while helix voltage $E_{hel}$ and collector voltage $E_{col}$ are raised is reduced compared to the related art illustrated in FIG. 1 since the anode voltage is restrained by Zener diode D1 (i.e., current-limiting circuit 77) connected between the helix electrode and the anode electrode. As a result, this can prevent TWT 1 from deterioration or damage. In addition, the reduced helix current also decreases the load on power supply apparatus 70 associated with inputting helix voltage $E_{hel}$ and collector voltage $E_{col}$.

After helix voltage $E_{hel}$ and collector voltage $E_{col}$ are raised, since transistor Q11 (of the switch 76) causes a short circuit between the helix electrode and the anode electrode of TWT 1, the potential of the anode electrode of TWT 1 is substantially the same as the potential of the helix electrode (i.e., the ground potential GND). This thereby prevents the maximum gain of TWT 1 from decreasing in normal operation.

Furthermore, in the high-frequency circuit system of this exemplary embodiment, since the anode voltage is controlled using Zener diode D1 and transistor Q11 a simple construction consisting of commonly used, inexpensive parts can be used to reduce helix current $I_{HELIX}$ in the case where helix voltage $E_{hel}$ and collector voltage $E_{col}$ are inputted. Therefore, it is possible to prevent the cost of the high-frequency circuit system from rising.

Figure 9:
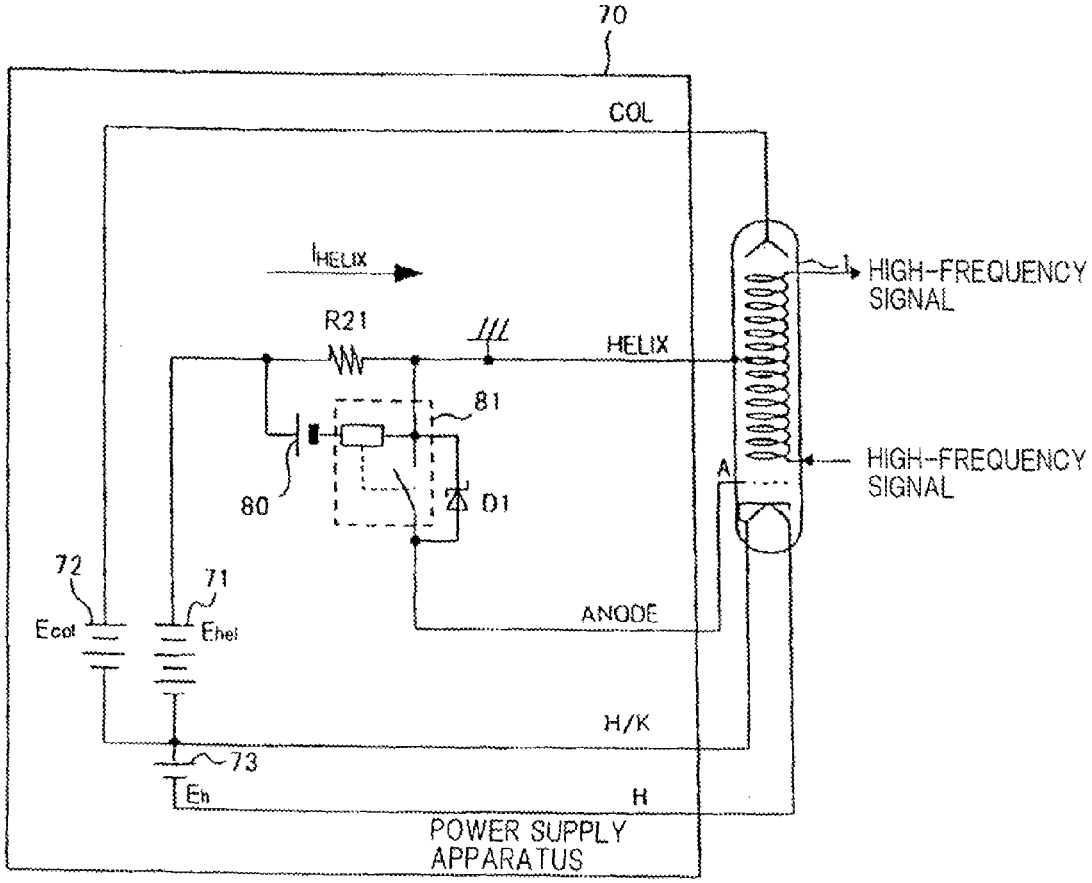
FIG. 9 is a block diagram illustrating the construction of a variation of the high-frequency circuit system according to the first exemplary embodiment.

Although FIG. 7 illustrates an exemplary construction in which switch 76 connected between the helix electrode and the anode electrode of TWT 1 is implemented with transistor Q11, switch 76 can be implemented with a relay as shown in FIG. 9.

FIG. 9 illustrates an exemplary construction in which a switch part of relay 81 is connected between the helix electrode and the anode electrode of TWT 1 and a drive part for driving the switch part is connected between the negative electrode of direct voltage source 80 and the positive electrode of helix power source 71. In this case, an output voltage from direct voltage source 80 is set to such a voltage level that turns on the switch part of relay 81 when TWT 1 performs a normal operation but turns off the switch part of relay 81 (that is, causes relay 81 to be below an operating voltage) due to the potential difference generated from current-detecting resistor R21 when an excessive amount of helix current $I_{HELIX}$ flows.

Even in the construction illustrated in FIG. 9, like the circuit illustrated in FIG. 7, at the beginning of inputting helix voltage $E_{hel}$ and collector voltage $E_{col}$, helix current $I_{HELIX}$ that flows while helix voltage $E_{hel}$ and collector voltage $E_{col}$ are raised is reduced compared to the related art illustrated in FIG. 1 since the anode voltage is restrained by Zener diode D1 (i.e., current-limiting circuit 77) connected between the helix electrode and the anode electrode. Accordingly the same effects as those of the circuit shown in FIG. 7 can be obtained.

(Second Exemplary Embodiment)

Figure 10:
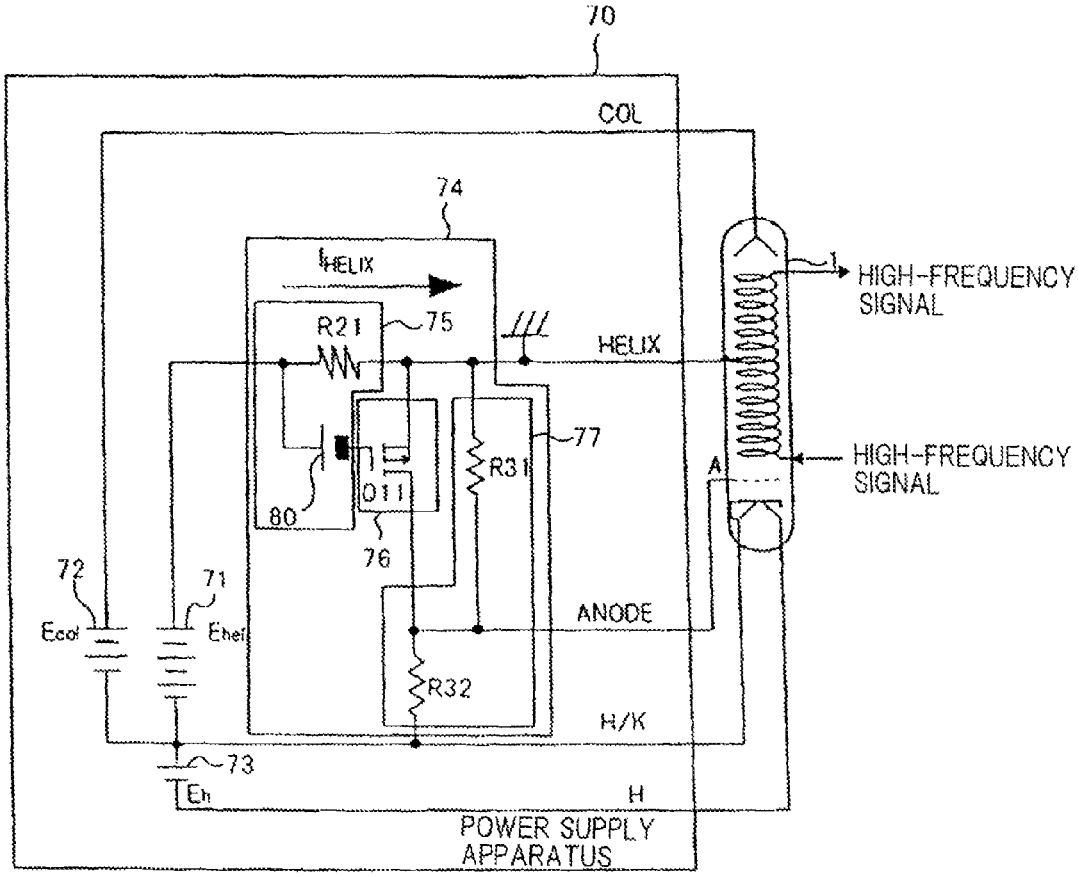
FIG. 10 is a block diagram illustrating the construction of a high-frequency circuit system according to a second exemplary embodiment.

FIG. 10 is a block diagram illustrating the construction of a high-frequency circuit system according to a second exemplary embodiment.

Referring to FIG. 10, power supply apparatus 70 according to the second exemplary embodiment includes resistors (voltage division resistors) R31 and R32, connected in series between the helix electrode and the cathode electrode of TWT 1, as voltage-limiting circuit 77 of voltage control apparatus 74. Power supply apparatus 70 is constructed to supply a division voltage, obtained by dividing helix voltage $E_{hel}$ using voltage division resistors R31 and R32, to anode electrode A. Since the other features of voltage control apparatus 74 and the constructions of power supply apparatus 70 and the high-frequency circuit system are substantially the same as those of the first exemplary embodiment, descriptions thereof will be omitted.

While FIG. 10 illustrates an exemplary construction in which helix voltage $E_{hel}$ is divided using the voltage division resistors R31 and R32 connected in series, the number of the voltage division resistors is not limited as long as helix voltage $E_{hel}$ can be divided before being supplied to anode electrode A.

In this exemplary embodiment, in the case where helix voltage $E_{hel}$ and collector voltage $E_{col}$ are applied, when transistor Q11 (of switch 76) is turned off, the voltage that is obtained by dividing helix voltage $E_{hel}$ using voltage division resistors R31 and R32 is applied to the anode electrode of TWT 1. Like the first exemplary embodiment, in the case where helix voltage $E_{hel}$ and collector voltage $E_{col}$ are inputted, helix current $I_{HELIX}$ is reduced compared to the related art illustrated in FIG. 1 since the anode voltage is restrained by voltage division resistors R31 and R32 (of voltage-limiting circuit 77) that are connected between the helix electrode and anode electrode. As a result, this can prevent TWT 1 from deterioration or damage. In addition, the reduced helix current also decreases the load on power supply apparatus 70 associated with inputting helix voltage $E_{hel}$ and collector voltage $E_{col}$.

After helix voltage $E_{hel}$ and collector voltage $E_{col}$ are raised, since transistor Q11 causes a short circuit between the helix electrode and the anode electrode of TWT 1, the potential of the anode electrode of TWT 1 is substantially the same as the potential of the helix electrode. This thereby prevents the maximum gain of TWT 1 from decreasing in normal operation.

Furthermore, in the high-frequency circuit system of this exemplary embodiment, since the anode voltage is controlled using voltage division resistors R31 and R32 and transistor Q11, a simple construction consisting of commonly used, inexpensive parts can be used to reduce helix current $I_{HELIX}$ in the case where helix voltage $E_{hel}$ and collector voltage $E_{col}$ are inputted. Therefore, it is possible to prevent the cost of the high-frequency circuit system from rising.

(Third Exemplary Embodiment)

Figure 11:
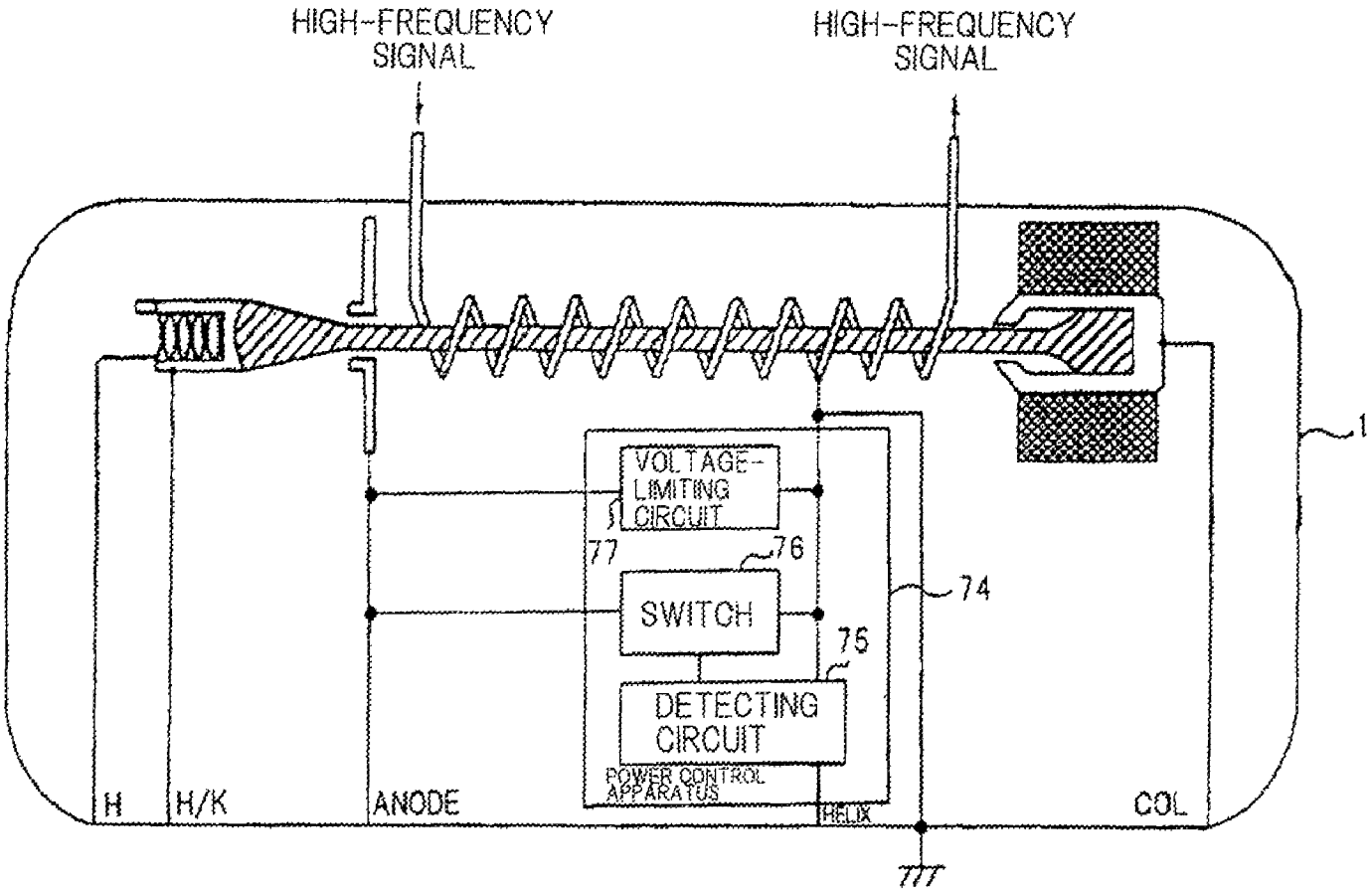
FIG. 11 is a block diagram illustrating the construction of a TWT having the voltage control apparatus shown in FIG. 5.

FIG. 11 is a block diagram illustrating the construction of a TWT having the voltage control apparatus shown in FIG. 5.

In the construction of the foregoing first and second exemplary embodiments, voltage control apparatus 74 is provided in power supply apparatus 70. As shown in FIG. 11, the third exemplary embodiment is constructed such that voltage control apparatus 74 disclosed in the first and second exemplary embodiments is provided in TWT 1.

As shown in FIG. 11 detecting circuit 75 of voltage control apparatus 74 has one end connected to the helix electrode and the other end connected to the helix power source of a power supply apparatus (not shown). The helix electrode is connected to the case of TWT 1 and is thereby grounded. In addition, switch 76 and voltage-limiting circuit 77 of voltage control apparatus 74 are connected between the helix electrode and anode electrode of TWT 1. Since operation of voltage control apparatus 74 shown in FIG. 11 is substantially the same as those of the first and second exemplary embodiment, a description thereof will be omitted.

Figure 12:
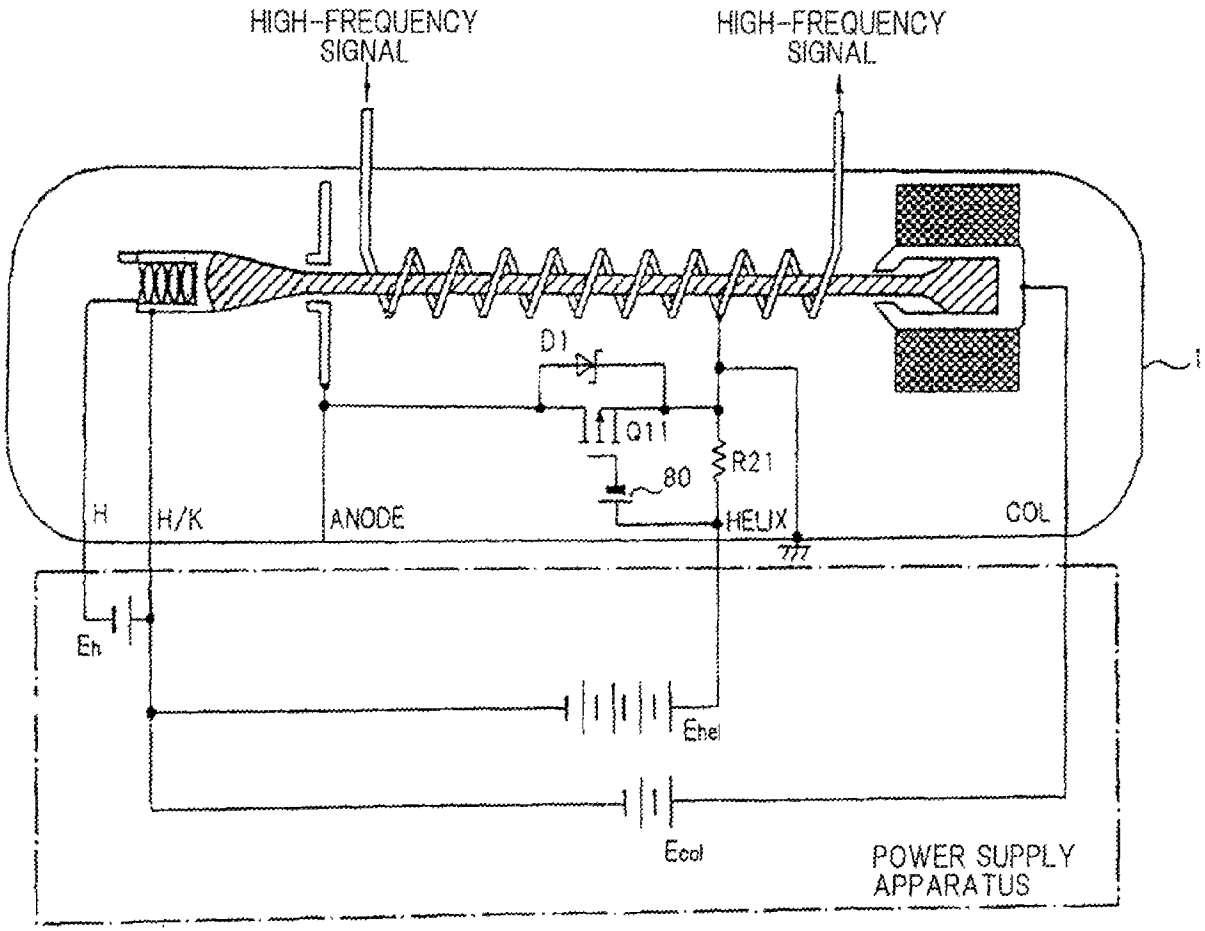
FIG. 12 is a block diagram illustrating the construction of a high-frequency circuit system according to a third exemplary embodiment.
Figure 13:
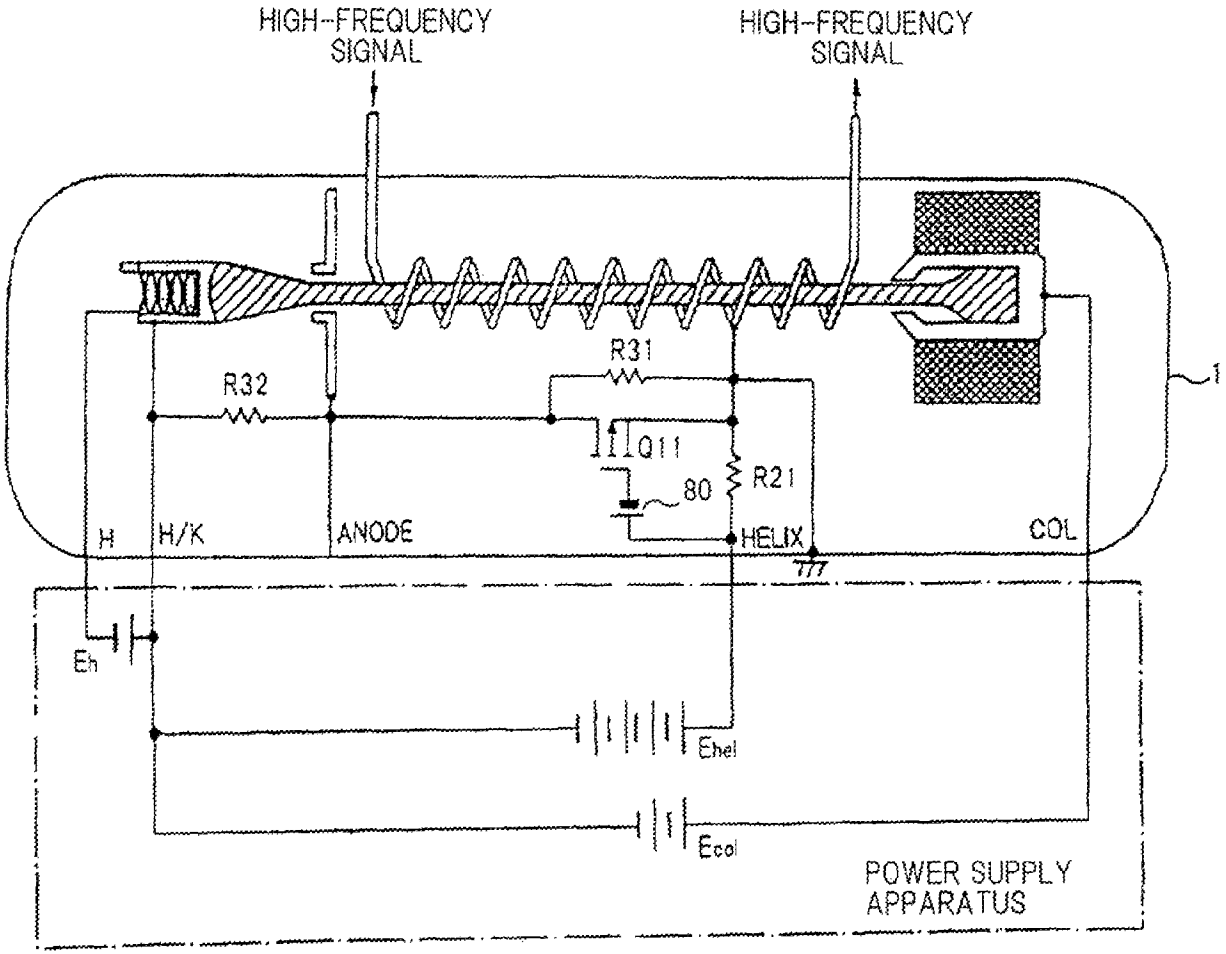
FIG. 13 is a block diagram illustrating the construction of a variation of the high-frequency circuit system according to the third exemplary embodiment.

FIGS. 12 and 13 are block diagrams illustrating exemplary constructions of a high-frequency circuit system according to a third exemplary.

In these drawings, FIG. 12 illustrates an exemplary construction in which voltage control apparatus 74 of the first exemplary embodiment shown in FIG. 7 is provided in TWT 1, and FIG. 13 illustrates another exemplary construction in which voltage control apparatus 74 of the second exemplary embodiment shown in FIG. 10 is provided in TWT 1. TWT 1 may be provided with voltage control apparatus 74 shown in FIG. 9. Since the other features and the operation of TWT 1 and the construction and operation of power supply apparatus 70 are substantially the same as those of the related art illustrated in FIG. 1, descriptions thereof will be omitted.

The third exemplary embodiment having voltage control apparatus 74 provided in TWT 1 can obtain the same effects as those that are obtained in the high-frequency circuit system of the first and second exemplary embodiments.

While the invention has been particularly shown and described with reference to exemplary embodiments thereof, the invention is not limited to these exemplary embodiments. It will be understood by those ordinarily skilled in the art that various changes in form and details may be made therein without departing from the spirit and scope of the present invention as defined by the claims.

What is claimed is:

1. A voltage control apparatus used for an electron tube, which includes at least an anode electrode, a cathode electrode and a helix electrode, comprising:

a detecting circuit for detecting a current flowing through the helix electrode;

a voltage-limiting circuit for controlling a potential difference between the helix electrode and the anode electrode based on a predetermined voltage level; and a switch for connecting the helix electrode and the anode electrode through the voltage-limiting circuit and causing a short circuit between the helix electrode and the anode electrode based on an output from the detecting circuit, wherein the detecting circuit includes:

a direct voltage source for outputting a predetermined direct voltage for turning on the switch when the electron tube performs a normal operation; and a current-detecting resistor for generating a potential difference according to the current flowing through the helix electrode and for decreasing the direct voltage, applied from the direct voltage source to the switch, to be smaller than an operating voltage of the switch based on the potential difference.

2. A voltage control apparatus used for an electron tube, which includes at least an anode electrode, a cathode electrode and a helix electrode, comprising:

a detecting circuit for detecting a current flowing through the helix electrode;

a voltage-limiting circuit for controlling a potential difference between the helix electrode and the anode electrode based on a predetermined voltage level; and a switch for connecting the helix electrode and the anode electrode through the voltage-limiting circuit and causing a short circuit between the helix electrode and the anode electrode based on an output from the detecting circuit, wherein the voltage-limiting circuit includes a Zener diode for limiting the potential difference between the helix electrode and the anode electrode to be smaller than a Zener voltage, the Zener diode being connected between the helix electrode and the anode electrode.

3. The voltage control apparatus according to claim 1, wherein the voltage-limiting circuit includes a plurality of voltage division resistors for dividing a voltage applied between the helix electrode and the cathode electrode and for supplying the divided voltage to the anode electrode.

4. A power supply apparatus comprising a voltage control apparatus as described in claim 1.

5. An electron tube comprising a voltage control apparatus as described in claim 1.

6. A high-frequency circuit system comprising:

a power supply apparatus as described in claim 4; and an electron tube in which a direct voltage from the power supply apparatus is supplied to an anode electrode, a cathode electrode and a helix electrode.

7. A high-frequency circuit system comprising:

an electron tube as described in claim 5; and a power supply apparatus for supplying a direct voltage to an anode electrode, a cathode electrode and a helix electrode of the electron tube.

* * * * *

UNITED STATES PATENT AND TRADEMARK OFFICE

CERTIFICATE OF CORRECTION

PATENT NO. : 8,212,481 B2
APPLICATION NO. : 12/395994
DATED : July 3, 2012
INVENTOR(S) : Yukihira Nakazato It is certified that error appears in the above-identified patent and that said Letters Patent is hereby corrected as shown below:

On the Title Page, left column, please delete the following,

Item "(73) Assignee: NEC Microwave Tube, Ltd., Kanagawa (JP)"

and please insert the following.

Item --(73) Assignee: NETCOMSEC CO. LTD, Tokyo (JP)--

Signed and Sealed this
Thirty-first Day of December, 2013

Margaret A. Focarino

Margaret A. Focarino
*Commissioner for Patents of the United States Patent and Trademark Office*